US008721343B2

(12) United States Patent
Davis

(10) Patent No.: US 8,721,343 B2
(45) Date of Patent: May 13, 2014

(54) SKI TEACHING APPARATUS AND METHOD

(76) Inventor: Joshua Thomas Davis, Webster, NY (US)

( * ) Notice: Subject to any disclaimer, the term of this patent is extended or adjusted under 35 U.S.C. 154(b) by 19 days.

(21) Appl. No.: 13/444,337

(22) Filed: Apr. 11, 2012

(65) Prior Publication Data

US 2013/0157237 A1 Jun. 20, 2013

Related U.S. Application Data

(60) Provisional application No. 61/577,043, filed on Dec. 18, 2011.

(51) Int. Cl.
*A63C 5/16* (2006.01)

(52) U.S. Cl.
CPC ..... *A63C 5/16* (2013.01)
USPC ..... 434/253; 482/71; 280/601; 280/809; 280/818

(58) Field of Classification Search
USPC ..... 434/253; 280/601, 809, 818, 819; 482/71
See application file for complete search history.

(56) References Cited

U.S. PATENT DOCUMENTS 1,440,565 A * 1/1923 Solbjor ..... 280/601
4,460,344 A * 7/1984 Notermann ..... 441/73
4,846,690 A * 7/1989 Williams ..... 434/253
5,378,156 A * 1/1995 Rohe ..... 434/253
2008/0111365 A1* 5/2008 Kraabel ..... 280/819
2010/0173273 A1* 7/2010 Bilbao ..... 434/253
2011/0109072 A1* 5/2011 Ligouri et al. ..... 280/818

OTHER PUBLICATIONS

"Loading the T-Bar," http://www.youtube.com/watch?v=tm5YpO8-h4Y, Jan. 2, 2010.*
"How to Ride a T-Bar," http://mpora.com/videos/wcwliPMO9, at least as early as Aug. 8, 2009 (posted "almost 5 years ago").*

* cited by examiner

*Primary Examiner* — Sam Yao
*Assistant Examiner* — Jennifer L Fassett

(57) ABSTRACT

A ski instructional apparatus and method for teaching young children that allows for dry land training of a student on skis. The apparatus includes a pole that the student straddles. The pole has a cross piece that extends behind the students legs and beneath the buttocks and handlebars for the student to hold onto. Pulling the pole forward causes the cross piece to push the student from behind so little or none of the student's arm strength is needed to pull the student on skis along a dry surface. The tips of the skis are connected by a tether and a line attached to the tether is connected to the pole. The arrangement allows the instructor to move the student forward and, at the same time, to move the ski tips one towards the other or allow the tips to move apart by respectively raising or lowering the pole.

3 Claims, 3 Drawing Sheets

SKI TEACHING APPARATUS AND METHOD

Ski Teaching Apparatus and Method. Claiming priority to provisional application No. 61/577,043, filed on Dec. 18, 2011.

CROSS-REFERENCE TO RELATED APPLICATIONS

None

STATEMENT REGARDING FEDERALLY SPONSORED RESEARCH OR DEVELOPMENT

None

REFERENCE TO A "SEQUENCE LISTING"

Not applicable.

BACKGROUND OF THE INVENTION

1. Field of the Invention

The present invention relates generally to a ski teaching apparatus and method and more particularly, to an apparatus and method for teaching toddlers to ski.

2. Background of the Invention

Many parents start ski instructions for their children soon after the child has learned to walk. At this age the child or toddler as young as two are fearless and take readily to instruction. While the toddler may be able to maintain balance on skis that are stationary, the problem is to get the child used to the sensations of motion while maintaining balance and control over the orientation of the skis especially during turning maneuvers. It also is desirable to acclimate the student to the sensation of motion in a dry land setting such as by pulling the student along a floor, rug, grass or other flat surface so the student is not intimidated by a slippery surface.

Various devices are available to assist in the ski instruction. One is a harness or halter worn around the student's upper torso or chest and shoulders. A strap or rope extending rearward from the harness or halter is held by the instructor and allows the instructor to retard the student's forward speed. If the strap or rope is attached at the front, the instructor can pull the student forward. Such devices, exemplified by U.S. Pat. Nos. 4,424,040; 4,509,921 ; and 5,074,795 are believed to actually inhibit a student's efforts to learn proper skiing techniques. In this respect, a restraining or pulling force exerted by the instructor on the student's waist or upper torso tends to pull the student, who is usually already unstable, further off balance. A further disadvantage is that since the strap or rope is not rigid, the instructor must choose either to be behind the student to retard forward speed or to be in front to pull the student forward. Ropes or straps which inherently are not rigid further do not lend themselves to changing the direction of the student.

Another type of ski training device as shown in U.S. Pat. No. 3,014,284 has a harness worn on the back of the instructor. A long rigid shaft extending rearward from the harness has handles at its end that are gripped by the student. This allows the student to ski along behind the instructor. A drawback of this type of device is that the instructor faces away from the student so it does not allow the instructor to readily observe the student skier. Also it does not provide stability to the student in that movements of the instructor are magnified by the length of the shaft and the long rigid shaft, being attached to the instructor, could present a hazard should either the instructor or student fall.

Another device, as shown in U.S. Pat. No. 5,120,227, allows the instructor and student to ski side-by-side. Here the device includes a single ski having an upright post. Two handles extend out from the post, one for the instructor and one for the student. The device provides a relatively rigid connection between student and instructor allowing the instructor to control speed and to help the student turn. However it does not allow the student to be pulled nor can it correct the orientation of the ski tips.

U.S. Pat. No. 5,378,156 shows another type of rigid connection between the instructor and student. Here the device is a pole having a cradle at one end that is held against the student's stomach area and a handles that are gripped by the student. With this device the instructor can control forward motion, either increasing or retarding the student's speed. It also allows the instructor to control the student's weight distribution and orientation to a slope by moving the cradle through a manipulation of the pole. However the device does not allow the instructor to manipulate the student's skis.

In addition to the specific drawbacks associated with each particular type of teaching device as described above, all of these these prior devices have several drawbacks in common. For example, none allow for dry land training such as by pulling the student on skis along a floor, rug, or grass surface. This is because if the student must maintain a firm grip on a rod, strap or rope in order to be pulled forward on a dry surface, the student's arm strength will soon be overtaxed. Pulling along a dry surface also may throw the student off balance by pulling the upper torso too far forward of a point of balance centered over the skis.

Also, none of the prior art devices make provision for controlling the orientation of the skis so the ski tips do not flare outwardly. None allow the instructor to turn both the student and the student's skis should the instructor move the student through a series of turns.

Prior to the present invention, it is believed that there has been no ski training device that provides stability to the student skier, particularly a very young student, and allows the instructor to control the orientation of the student's skis, observe the student's actions and give oral instructions all while the instructor skis, walks alongside or pulls the student skier forward. Also, it is believed that none allows for dry land training by moving a student on skis along any flat surface other than snow.

Accordingly, it is an object of the present invention to provide a ski teaching apparatus and method that allows the instructor to conduct dry land training by pulling a student wearing skis along any dry surface such as a floor, rug or grass.

Another object is to provide a ski teaching apparatus and method that allows the instructor to correct for the tendency of the ski tips of to flare outwardly.

A further object of the present invention is to provide a ski teaching apparatus and method that allows the instructor to change the direction both of the student's ski tips and the body of the student.

A still further object of the present invention is to provide a ski teaching apparatus and method that allows the instructor to pull the student forward without disrupting the balance of the student.

Yet another object of the invention is to provide an apparatus and method for teaching young children to ski in which the instructor can control the speed of forward motion, the orientation of the tips of the student's skis and the direction of travel all from a position in front of or alongside the student.

BRIEF SUMMARY OF THE INVENTION

The apparatus of the present invention comprises a pole that the student straddles. The pole has a cross piece at one end that acts to support the student from behind, handles that the student can grasp, and a grip at the opposite end of the pole for the instructor.

With the student straddling the pole and gripping the handles, the instructor can pull the student along any surface including any dry surface such as a floor, carpet, or grass as well as over snow. The cross piece supports the student from behind so that as the instructor pulls the pole forward, the instructor's pulling action is converted to a force transmitted to the student from behind. Accordingly, rather than the student being pulled forward by having to hold tight to the handles, the student pushed forward from behind.

The ski tips preferably are connected by a tether and the tether is attached to a rope. By pulling on the rope or allowing it to go slack, the instructor can change or correct the tendency of the ski tips to flare apart. Attaching the rope to the pole allows the instructor to do this simply by raising or lowering the gripped end of the pole. In this respect raising and lowering the grip respectively pulls the rope taught or slacks the rope to correct flare and to keep the skis parallel. The combination of the pole and rope further allows the instructor to turn both the student and the ski tips in order to swing or turn the student from side-to-side during forward travel.

Accordingly, the present invention may be characterized in one aspect thereof by ski instruction apparatus, particularly for teaching a child to ski, comprising:

a) a tether attachable between the tips of skis worn by a student skier, the tether preventing the ski tips from flaring outwardly beyond a given orientation;

b) a pole having a first end for straddling by the student skier;

c) a handle on the pole forward of the first end for gripping by the student skier;

d) the pole having a second end that is gripped and pulled forward by a ski instructor for moving forward the student skier straddling the pole;

e) means associated with the pole for converting a forward pulling action of a ski instructor to a force pushing the student from behind; and f) a line connected to a midpoint of the tether such that i) putting tension on the line causes the tether to draw the ski tips inward one towards the other and ii) slacking the line slacks the tether allowing the ski tips to move apart one from the other.

In its method aspect, the present invention comprises a ski instructing method, particularly for teaching a child to ski, the method comprising:

a) tethering together the tips of the skis of a student skier to prevent the ski tips from flaring outwardly beyond a given orientation;

b) placing the student skier astride a pole, the pole having handles for gripping by the student skier;

c) moving the pole forward by having a ski instructor grasp and pull on a second end of the pole;

d) converting the forward pulling action of the ski instructor to a force pushing the student skier from behind; and e) controlling the orientation of the ski tips by either pulling on a line attached to a midpoint of the tether to draw the ski tips together or slacking the line to allow the ski tips to move apart.

DETAILED DESCRIPTION OF THE INVENTION

Figure 1:
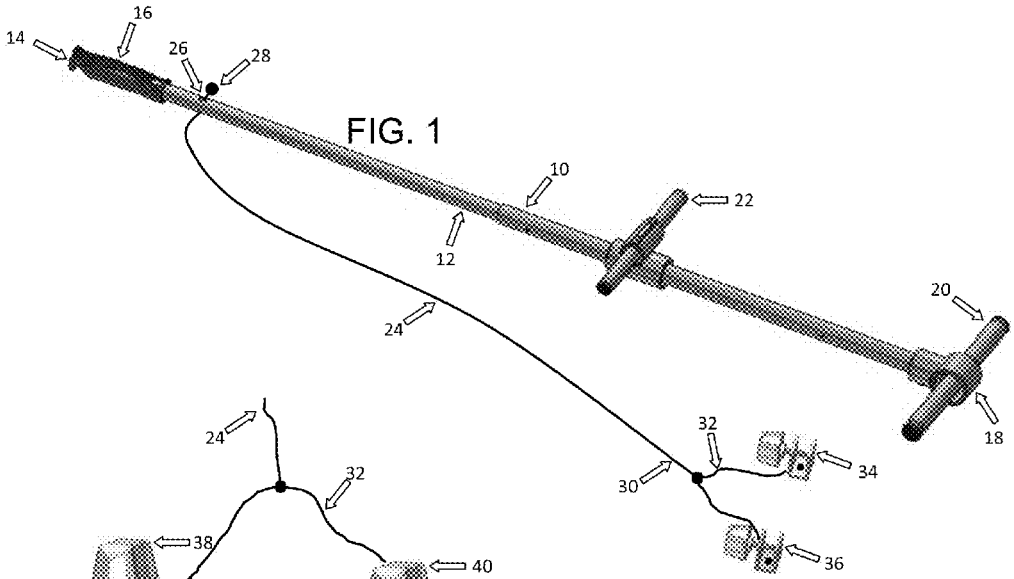
FIG. 1 is a perspective view showing the ski teaching apparatus of the present invention.

Referring to the drawings, FIG. 1 shows the teaching apparatus of the present invention generally indicated at 10. The apparatus includes a rigid pole 12 having a first end 14 provided with a grip 16. Attached to a second or opposite end 18 of the pole. is a cross piece 20 and spaced forward from the cross piece is a handle 22.

The apparatus further includes a rope or line 24. The line 24 has one end passing through a hole 26 in the pole and tied in a knot 28 to prevent the line from slipping out of the hole. The opposite end 30 of the line is connected to the midpoint of a tether 32.

Figure 4:
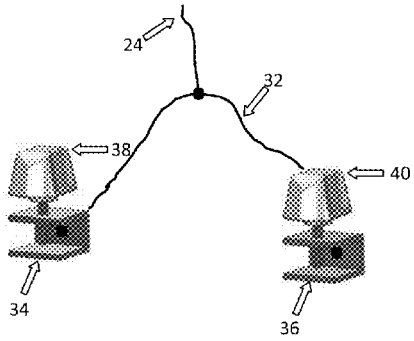
FIG. 4 is a view on an enlarged scale showing a portion of the apparatus of the present invention.

The tether 32 has each of its ends connected to clips 34,36 that are in turn constructed and arranged to attach to the tips of the skis of the student skier. As shown in FIG. 4, each clip 34,36 comprises a generally C-shaped member that is of a size able to fit over the tip of the student's ski. A screw 38,40 on each clip can be screwed in to firmly attach the clips to the tips of the student's skis.

Figure 2A:
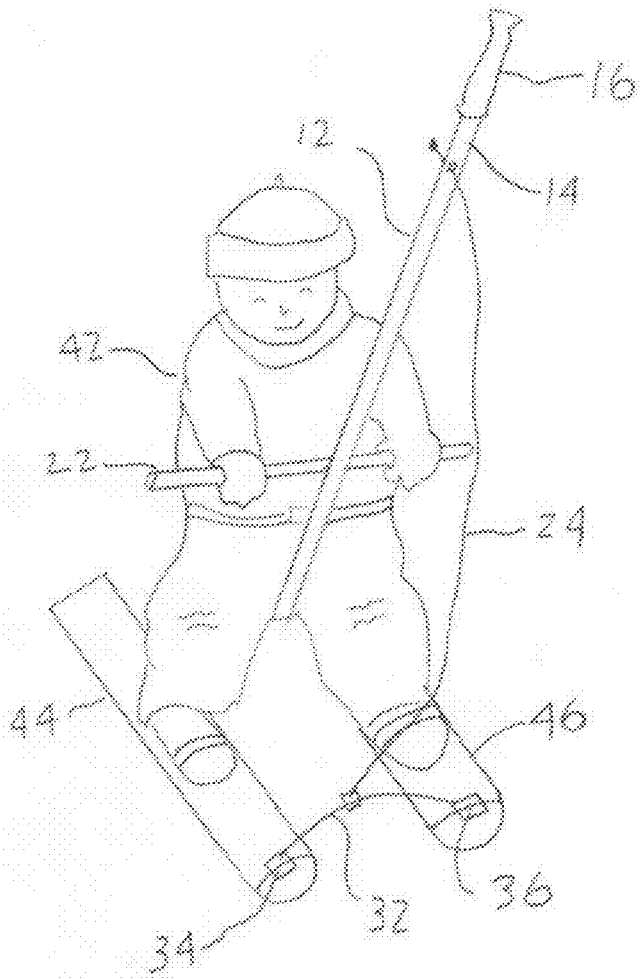
FIG. 2A is a front view showing the apparatus of the present invention in use with a ski student being pulled by an instructor.
Figure 3A:
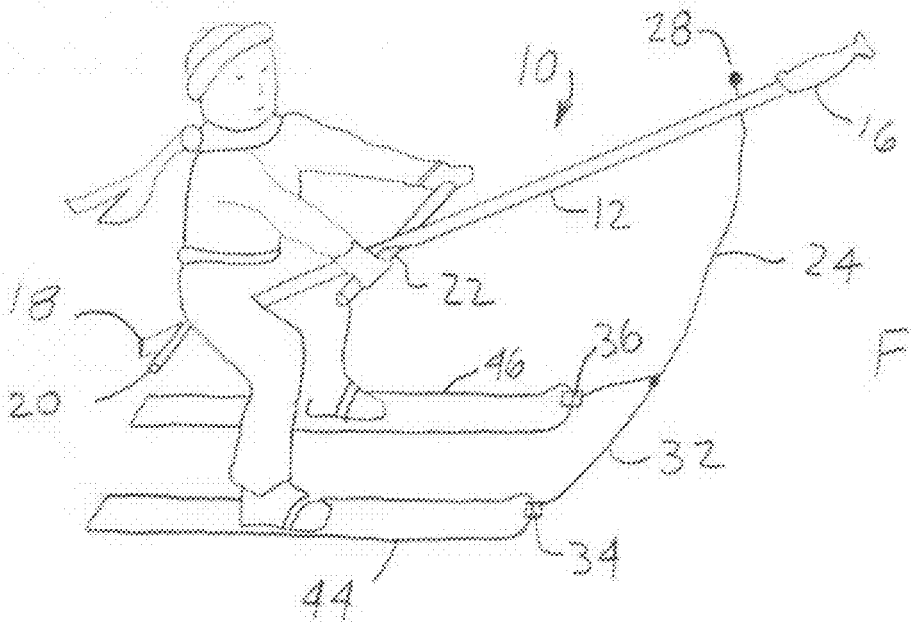
FIG. 3A is a view similar to FIG. 1 showing the apparatus in use from the side.

FIGS. 2A and 3A show the apparatus of the present invention in use. In this respect, the figures show a young student skier 42 on skis 44,46. The clamps 34,36 are attached to the tips of each ski 44,46 so that the length of the tether 32 limits the amount that the ski tips can flare apart.

The young student 42 on the skis is put astride the opposite end 18 of the pole 12 with the cross piece 20 being located behind the legs of the student and preferably just under the buttocks of the student. The student is shown holding on to the handle 22 while the instructor grasps the grip 16 at The instructor holding onto the grip 16 now can move forward, either walking in front of the student or along side the student. The instructor either can walk backward facing the student or walk forward facing away from the student. As the instructor moves forward the student also is moved forward. However, the student's forward movement is not dependent on the arm strength of the student holding onto the handlebars 22. This is because the action of the instructor pulling on the pole is converted to a force pushing the student from behind so the student is pushed along rather than being pulled along. Moreover, this pushing force generally is applied below the center of gravity of the student so the student is not thrown forward and put off balance.

The instructor, while moving the student forward, can adjust the orientation of the ski tips to help maintain them at a any desirable orientation and preferably at a substantially parallel orientation. For example, should the ski tips start to flare too far apart, the instructor simply pulls on the knot 28. This places the rope 24 in tension, which acts through the tether and the clips 34,36 to draw the ski tips one towards the other. It also is possible to control the orientation of the ski tips by changing the elevation of the pole. Raising or elevating the grip puts the rope in tension to draw the ski tips together whereas lowering the grip slacks the rope and allows the ski tips to flare apart.

The apparatus further allows the instructor to direct or turn the student by moving the grip 16 to the right or the left. Since the student is holding onto the handles, the student's upper torso is turned in unison with the pole as the pole is swung right or left by the instructor. The instructor also controls the direction of the skis in that the rope 24 is connected between the pole and the ski tips. Accordingly, the student's body orientation and the ski orientation are adjusted in unison by the instructor so long as the student holds on to the handles and the clips 34,36 remain attached to the ski tips.

It is important to note that the apparatus allows for dry land training of the student because the apparatus, while being pulled by the instructor, in effect pushes the student from behind at a location below the student's buttocks and therefore below the student's center of gravity. The student merely holds on to the handles for support rather than the student needing a tight grip to counteract the higher friction between the skis and a dry surface.

Figure 5:
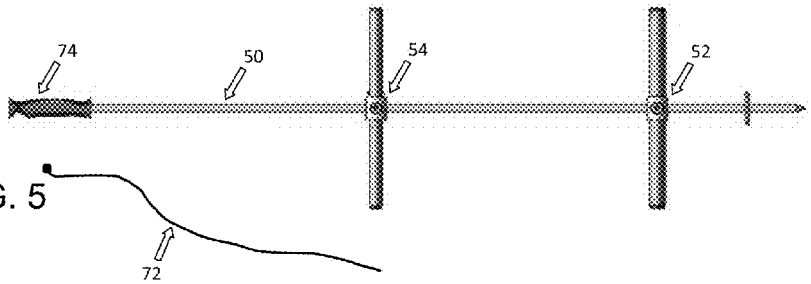
FIG. 5 is a plan view showing another embodiment of the present invention.
Figure 6:
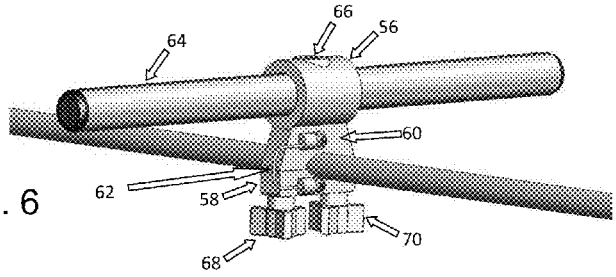
FIG. 6 is a view on an enlarged scale showing a portion of the apparatus of FIG. 5.
Figure 2B:
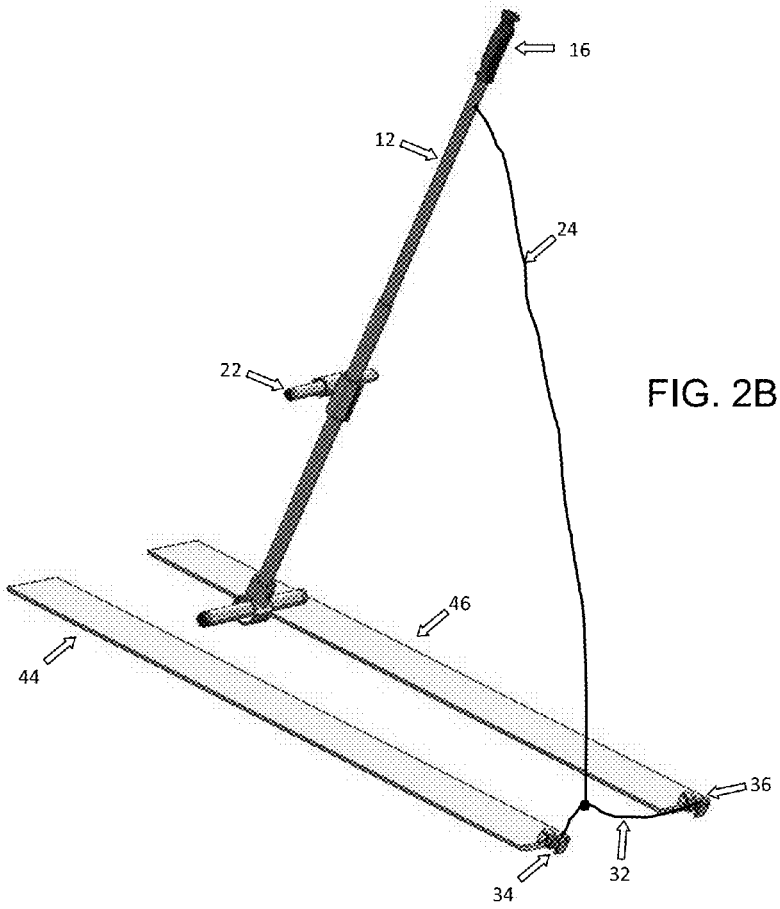
FIG. 2B is the same view without the student skier.
Figure 3B:
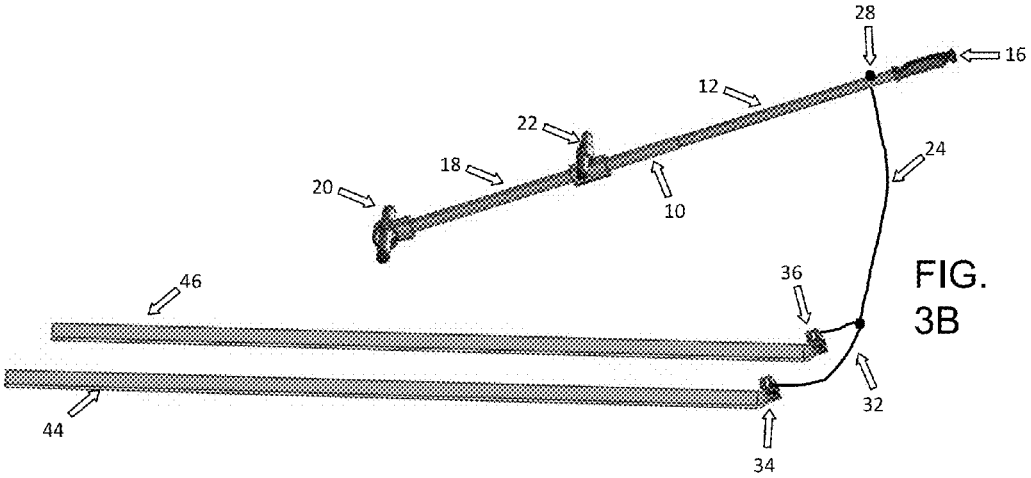
FIG. 3B is the same view without the student skier.

FIGS. 5 and 6 show another embodiment of the invention. Here a conventional ski pole 50 having a hand grip 74 is modified so as to perform the function of the pole 12 of FIGS. 1-3. This is done by clamping a pair of members 52,54 to the ski pole. Each member 52,54 as best seen in FIG. 6 comprises a split hub 56 formed of two sections 58,60. The two sections are connected at one end by a hinge 62 so the split hub 56 can open or close about the ski pole. Extending from the section 56 of the split hub is a rod 64, held in place by a screw 66 respectively. The rod 64 of each member 52,54 function as the cross piece 20 and handles 22 of the embodiment shown in FIGS. 1-3.

The two sections 58,60 of each split hub are swung apart so that the hub can be placed about the ski pole. The sections 58,60 are then swung together and connected by any suitable means such as a thumb screws 68,70 in one section 58 that screws into a hole in the other section 60. In this embodiment the rope or line 72 is not attached to the pole but in use is merely secured by one hand of the instructor while the other grips the ski pole handle or is gripped by the instructor in the same hand that grips the ski pole handle.

Accordingly, it should be appreciated that the present invention accomplishes it intended objects in providing an apparatus and method for teaching young children to ski. The invention allows the instructor to conduct dry land training by pulling the student along any flat surface other than snow such as a floor, rug or grass. The invention further permits the instructor to pull the student on skis along a dry surface without depending upon the student's grip or arm strength to keep hold of the apparatus and overcome the high friction as the student is pulled along. This is particularly important when teaching very young children that have very limited arm strength.

The apparatus further provides a ski teaching method and apparatus that allows the instructor to correct for the tendency of the ski tips of to flare outwardly and allows the instructor to turn both the student's body and the skis so as to maintain a proper orientation of one to the other. With the student straddling the pole and with the cross piece behind the legs of the student and with an arrangement to control the ski tips, the instructor can pull the student forward without disrupting the balance of the student and can control the speed of forward motion, the orientation of the tips of the student's skis and the direction of travel all from a position in front of or alongside the student.

Having described the invention in detail, what is claimed as new is:

1. A ski instructing method for teaching a child to ski, the method comprising: a) tethering together the tips of skis worn by the child to prevent the ski tips from flaring outwardly beyond a given orientation; b) placing the child astride an end of a pole, the pole end having a cross piece that locates behind the legs and beneath the buttocks of the child astride the pole and the pole having a handle forward of the cross piece for gripping by the child; c) moving the pole forward by an instructor grasping and pulling on an opposite end of the pole, the cross piece acting to convert the forward pulling by the instructor to a force pushing the child from behind; and d) controlling the orientation of the ski tips by pulling on a line attached to a midpoint of the tether to draw the ski tips together and slacking the line to allow the ski tips to flare apart to the given orientation.

2. A ski instructional method as in claim 1, wherein at the given orientation, the skis are substantially parallel.

3. A ski instructional method as in claim 1, wherein controlling the orientation of the ski tips is accomplished by attaching an end of the line to the pole opposite end so that raising the pole opposite end pulls on the line and lowering the opposite end slacks the line.

* * * * *